United States Patent [19]

Jones

[11] Patent Number: 4,886,478

[45] Date of Patent: Dec. 12, 1989

[54] WIND PROPELLED SAIL TOY VEHICLE

[76] Inventor: Daniel R. Jones, 1428 Peach Ave., #6, El Cajon, Calif. 92021

[21] Appl. No.: 246,431

[22] Filed: Sep. 19, 1988

[51] Int. Cl.[4] ..... A63H 29/10; A63H 23/04; A63H 30/00

[52] U.S. Cl. ..... 446/176; 446/154; 446/454; 280/62; 244/16

[58] Field of Search ..... 446/176, 199, 163, 154, 446/454; 280/213, 62; 244/16

[56] References Cited

U.S. PATENT DOCUMENTS

| | | | |
|---|---|---|---|
| D. 242,611 | 12/1976 | Schlitter | 280/213 X |
| 3,392,485 | 7/1968 | Asano | 446/454 |
| 3,671,694 | 6/1972 | Masuda | 446/454 X |
| 4,332,395 | 6/1982 | Zech | 280/213 |
| 4,408,772 | 10/1983 | Höllwarth | 280/213 X |
| 4,426,806 | 1/1984 | Woodworth | 446/454 |
| 4,458,859 | 7/1984 | Ganev | 244/16 |

FOREIGN PATENT DOCUMENTS

| | | | |
|---|---|---|---|
| 2839939 | 3/1980 | Fed. Rep. of Germany | 280/213 |
| 923656 | 7/1947 | France | 446/163 |

*Primary Examiner*—Robert A. Hafer
*Assistant Examiner*—D. Neal Muir
*Attorney, Agent, or Firm*—Bernard L. Kleinke; Jerry R. Potts; William P. Waters

[57] ABSTRACT

The sail toy land vehicle includes a generally rod-like elongated frame or central body, having a raised forward portion, an elongated rigid rear wheel axle structure includes a pair of rear outrigger wheels to help support the vehicle rollably along the ground. An aerodynamic upright sail structure has a sail positioned such that its center of gravity is disposed approximately over the rear axle structure of the vehicle, and positioned in a rearwardly inclined manner.

7 Claims, 2 Drawing Sheets

10
C.G.
29
30
62
42
44
14
45
27
41
71
24
19
16
15

30
32
35
33
25

C.G.
34
22
63
21
71
61
29
26
31
60
56
28
62
42
12
41
44
46
14
21
58
59
19
27
47
45
24
43
40
50
20
55
49
16
51
18
52
17
15

WIND PROPELLED SAIL TOY VEHICLE

TECHNICAL FIELD

The present invention relates in general to a radio controlled toy vehicle, and it more particularly relates to a new and improved radio-controlled wind-propelled sail toy vehicle, which exhibits a high degree of stability and maneuverability, even at high speeds.

BACKGROUND ART

There have been many different kinds and types of wind-propelled sail toy vehicles and recreational vehicles known in the art. Typically, such land vehicles include a sail for capturing the wind, a set of wheels for permitting the toy or vehicle to travel along the ground and a mechanism for steering or directing the toy or vehicle in its course of travel. For example, reference may be made to the following U.S. Pat. Nos. 2,351,542; 3,572,740; 4,049,287; 4,332,395; and 4,408,772.

While such prior known devices may have been successful in some applications, it has been difficult, if not impossible, to stabilize the toy or vehicle to prevent it from tipping over, while at the same time permitting it to travel at a relatively high rate of speed. Thus, several conventional sail toys or vehicles have employed stabilizing techniques in an attempt to allow the vehicle or toy to remain upright in a controlled manner, while permitting the vehicle or toy to be propelled rapidly along the ground by the wind.

One such attempted technique, as disclosed in U.S. Pat. No. 4,426,806 includes using a wheeled outrigger assembly, which is flexible along its length, so that as the vehicle is driven into a heeling position, the heeling is opposed by the resiliency of the outrigger to help maintain it in an upright manner. In this manner, the wheeled vehicle tends to approximate the reaction of a water-born sailing vessel which is wind driven. While such an attempt tends to reduce the instability of the vehicle as it is propelled along the ground. Such a technique has proven to be less than totally satisfactory, in that other problems result from such a construction. In this regard, the flexible outrigger assembly can be subjected to damage caused by bending, when the vehicle has heeled over due to excessive wind forces. Furthermore, such a prior known design does require the use of two (2) additional wheels for a total of five (5). In addition, assembly of the vehicle is unduly complicated, and thus assembly time has been unacceptably long for some applications, because of the need for installing the special outrigger assembly.

Therefore, it would be highly desirable to have a light-weight wind-propelled sail toy for overcoming the problems associated with instability, especially at high speeds, without the need for flimsy and flexible outrigger assemblies. Such a light-weight high-speed vehicle should be easily and safely maneuvered with little or no danger of tipping over inadvertently at high speeds while traveling along the ground.

Another attempted solution has been described in U.S. Pat. No. 3,280,501 which a model sailboat is provided with a radio controlled steering of a main sail, as well as a radio controlled rudder, to enable an operator of the vessel to approximate trimming of the main sheet, in order to prevent capsizing as the vessel reacts to the wind. However, while such an attempt could reduce the instability of the vehicle, it has a major disadvantage when the principles of the U.S. Pat. No. 3,280,501 are applied to land vehicles as contemplated by the present invention. In a traditional tricycle type wheel arrangement, a land vehicle does not respond in a heeling manner that is similar to that experienced in water-borne vessels. In other words, a land vehicle is level with the ground unless and until the model heels. In this regard, should the wind velocity overcome the center of gravity of the vehicle, it heels over very abruptly, without any notable resistance to the wind. Therefore, there is no time for the operator to react by adjusting the mast to prevent the vehicle from overturning.

Therefore, it would be highly desirable to have a light-weight wind-propelled sail toy for overcoming the problems associated with instability during high speed operation. Such a vehicle should be very stable under a variety of wind conditions, to prevent, or at least greatly reduce the risk of unexpectedly overturning the vehicle.

Such a vehicle should be relatively inexpensive to manufacture. It should also be able to be assembled and disassembled in a convenient manner. In this regard, once disassembled, it should be able to be stored or transported in a convenient manner.

DISCLOSURE OF INVENTION

The principal object of the current invention is to provide a new and improved radio controlled wind-propelled sail toy vehicle, which exhibits a high degree of stability to reduce greatly the danger of tipping over, even at high speeds.

Another object of the present invention is to provide such a new and improved sail toy vehicle, which is relatively inexpensive to manufacture, and which can be conveniently disassembled and stored in a compact manner for storage or transporting purposes.

Briefly, the above and further objects of the present invention are realized by providing a radio controlled wind-propelled sail toy vehicle, that is highly maneuverable, and yet stable under varying wind conditions and at high speeds.

The sail toy land vehicle includes a generally rod-like elongated frame or central body, having a raised forward portion, an elongated rigid rear wheel axle structure includes a pair of rear outrigger wheels to help support the vehicle rollably along the ground. An aerodynamic upright sail structure has a sail positioned such that its center of gravity is disposed approximately over the rear axle structure of the vehicle, and positioned in a rearwardly inclined manner.

The positioning of the sail structure enables the light-weight toy vehicle to remain upright while traveling at high speeds along the ground. Also, the rear wheel axle structure is removably mounted at the rear end of the body for fast assembly of the unit, thereby allowing the unit to be disassembled conveniently for storage or transportation purposes.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figures 1, 2:
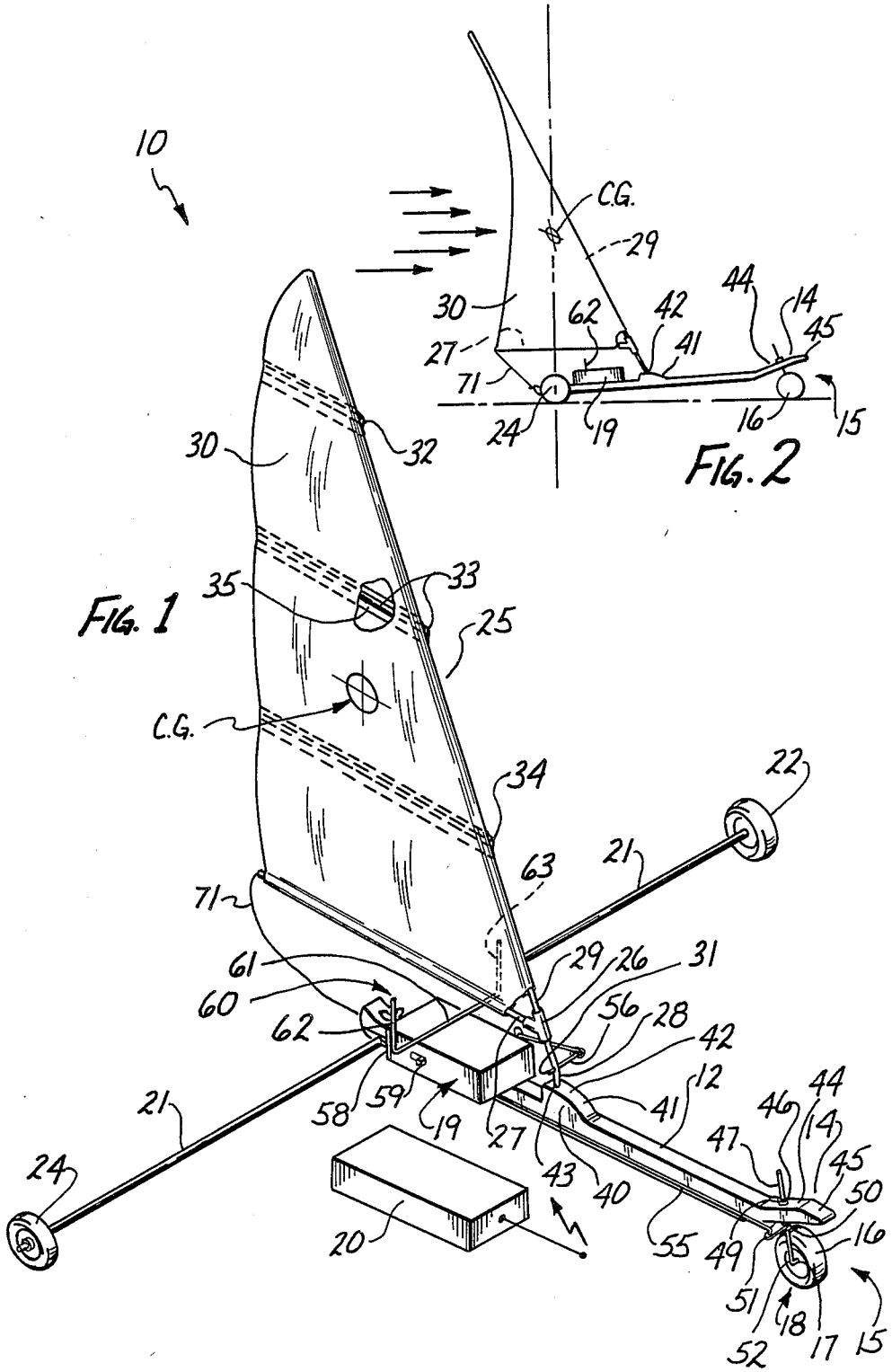
FIG. 1 is a pictorial view showing the land sail toy vehicle, which is constructed in accordance with the present invention.
FIG. 2 is a reduced scale, partially schematic, right side elevational view of the toy vehicle of FIG. 1.
Figure 6:
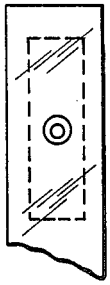
FIG. 6 is an enlarged fragmentary top view of the front portion of the land sail toy vehicle of FIG. 1.

Referring now to the drawings, and more particularly to FIGS. 1–4 thereof, there is shown a new improved wind propelled radio controlled sail toy vehicle 10 which is constructed in accordance with the present invention.

As best seen in FIG. 1, the radio controlled sail toy vehicle 10 is modular in construction and generally comprises an elongated longitudinally-extending rod-like central frame or body member 12 having a raised or upturned front end or tip portion generally indicated at 14. Mounted on the front end 14 of the frame 12 for helping support its rollably along the ground, is a front wheel steering assembly 15, which includes a front axle 17 supporting a front wheel 16. A radio controlled servo mechanism and receiver unit 19 activated remotely by a hand held transmitter 20, causes the front axle 17 to be turned steerably in a remotely controlled manner. The servo mechanism and receiver unit 19 includes a front wheel steering servo mechanism (not shown), a mast assembly servo mechanism (not shown), and a radio receiver (not shown) which drives the servo mechanisms. All three units are disposed within the housing 19A, and are battery powered.

A transversely-extending elongated rigid rear outrigger axle member 21 has a pair of respective outrigger wheels 22 and 24 at the outer ends thereof spaced equally by a distance X (FIG. 4) from the frame 12. The rear outrigger axle member 21 is in the form of a metal rod and is detachably fixed at the rear end of the frame. The rear axle extends transversely therefrom to provide a T shape with the frame 12. A substantially equal portion of the rear axle member 21 extends transversely from either side of the frame 12 (designated as a length "X" at opposite sides of the frame in FIG. 4) for helping balance the toy vehicle 10 dynamically.

The set of wheels 16, 22 and 24 are suitably journalled for rotation at each respective free end of the front and rear axles 17 and 21 for supporting the frame 12 rollably along the ground.

An upright mast assembly 25 is detachably and swingably mounted to the frame 12 and includes a pair of booms 27 and 29, which are adapted to receive a sail 30 for capturing or receiving a wind force to propel the toy vehicle 10 along the ground. For controlling boom tack position of the vehicle 10 remotely, the mast assembly 25 is also coupled to the radio controlled servo mechanism and receiver unit 19 for turning or swinging the mast assembly 25 remotely.

In use, the toy vehicle 10 is placed on the ground by a user who activates its servo mechanism and receiver unit 19. The user, via the transmitter 20 then sends a radio control signal to the servo mechanism and receiver unit 19 to cause the mast assembly 25 to swing to a desired position where the sail 30 is positioned to capture the wind for propelling the toy vehicle rollably along the ground.

In order to maintain movement of the toy vehicle 10 as it rolls along the ground under the force of the wind, the operator of the toy vehicle 10 must operate the transmitter 20 to cause the front steering assembly 15 and the mast assembly 25 to be adjusted directionally to compensate for changes in wind direction as well as changes in vehicle direction relative to the wind.

The precise functioning of a sail on a land vehicle is a somewhat complex phenomenon. For example, the sail serves as a wind catching area. Secondly, because of its curvature or billowing under wind pressure, a sail develops aerodynamic characteristics, comparable to that of an aircraft wing, to provide a forward suction or reduced pressure effect acting on the outside (convex side) of the billowing sail. Finally, due to the direction of the wind in relation to the vehicle it is usually variable and changeable, so the wind exerts different forces acting on the sail.

It should therefore be understood that as the operator controls the direction of the toy vehicle 10 relative to the wind, the vehicle 10 may heel and lift up one of the outrigger wheels as it is maneuvered. This heeling effect of the toy vehicle 10 however, is rapidly and effectively killed by reason of the center of gravity of the mast assembly 25 being disposed substantially over the rear axle 21 so as to compel the rear wheels 22 and 24 of the toy vehicle 10 to the ground as the vehicle 10 makes its tracking maneuvers.

Thus, as tacking is being executed, the wind pressure is acting to heel the vehicle over which would otherwise, in strong wind conditions, tend to upset the vehicle very abruptly. According to the present invention, however, the inventive arrangement of the elongated rigid outrigger rear axle member 21, the counter balanced rod-like frame 12 with its raised forward section, and the orientation of the central portion of the sail 30 over the rear axle of the toy vehicle 10 aerodynamically balance it so that it is able to tack and heel in a manner similar to a boat. Thus, the vehicle 10 tends to remain upright and is propelled by the wind at high rates of speed.

Figure 3:
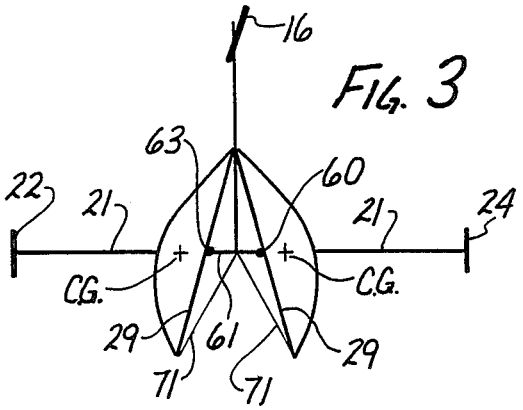
FIG. 3 is a schematic plan view showing the land sail toy vehicle of FIG. 1, illustrating two boom positions.

Considering now the arrangement of the elongated rigid outrigger rear axle member 21, the counter balanced rod-like frame 12 with its raised front section and the orientation of the mast assembly in greater detail with reference to FIGS. 1, 2, and 3, the mast assembly 25 extends upwardly and backwardly relative to the frame 12 so that the mast booms 27 and 29 of the mast assembly 25 terminates substantially beyond the rear axle. In this manner the center of gravity (C.G.) of the mast assembly is disposed substantially over the rear axle member 21. In order to maintain the center of gravity of the mast assembly 25 substantially over the rear axle member 21 as the mast assembly is swung from side to side, the toy vehicle 10 is provided with a pair of stops 62 and 63 and a restraining cable 71. Thus, as the mast assembly swings from side to side the stops 62 and 63 as well as the restraining cable 71, limit and substantially prevent the center of gravity of the mast assembly from extending forwardly of the rear axle member 21.

In this manner, it should be understood that dynamic balancing substantially counteracts any unstable condition that could otherwise overturn the toy vehicle 10 by the mast 30 swinging away from and forwardly of the rear axle member 21.

Considering now the frame member 12 in greater detail with reference to FIGS. 1 and 2, the frame member 12 is generally a rigid central body of uniform thickness. The frame 12 is generally rectangular in cross section throughout its length, with an integral upstanding protuberance 40 centrally disposed for supporting the bottom end of the mast assembly swingably. For the purpose of providing an aerodynamic, low wind resistance surface, the protuberance 40 includes a smoothly contoured angular front portion 41 extending upwardly and rearwardly along the longitudinal axis of the frame 12 starting at a point at approximately the midpoint of the frame 12 and terminating in a flat top portion 42. The flat top portion 42 is substantially square-shaped and terminates at a rear edge that projects downwardly to the main body of the frame 12. A hole (not shown) is disposed in the center of the flat top portion 42 of the protuberance 40 and is adapted with a pivot socket (not shown) to removably receive and pivotally secure the mast assembly 25 to the frame 12.

The rear portion of the frame 12 is split and disposed with a recess 36 that is adapted for receiving the rear axle member 21. A bolt 37 is adapted to pass through the frame 12 adjacent the recess 12 so that the axle member 21 inserted in the recess 36 may be rigidly clamped in place by the bolt 37 as it is secured to the frame 12 by a wing nut 38.

The front portion 14 of the frame 12 includes an inclined plane portion 44 that extends upwardly and forwardly along the longitudinal axis of the frame 12 and terminates in a top flat portion 45. The top flat portion 45 is substantially square-shaped and terminates at the forward terminal edge of the frame 12. A hole 46 is disposed in about the mid part of the plane portion 44 and is adapted to receive the front wheel assembly 18. The angle of inclination for the front inclined plane portion 44 of the frame is dimensioned so that the wheel 16 may be equal in size to the rear wheels 22 and 24 and to maintain rollability of the front wheel 16 to prevent loss of wheel to ground contact or unwanted skidding as the vehicle 10 makes tight fast turns.

Considering now the front wheel assembly 18 in greater detail with reference to FIGS. 1 and 2, the front wheel assembly 18 includes a bearing sleeve (not shown) that is adapted to be securably received within the hole 46. The front wheel assembly 25 further includes an axle bar 47 that is adapted to be received rotatably within the sleeve. A set nut 49 is received over the axle bar 47 and removably secures the axle bar 47 adjacent the top surface of the inclined plane portion 44 of the frame 12. A lower set nut 50 having an extension area 51 is received on the lower portion of the axle bar 47 and removably secures the axle bar 47 adjacent the bottom surface of the inclined plane portion 44 of the frame 12. The extension arm 51 is adapted with a pair of mounting holes (not shown) for receiving a steering control cable 55 attached to the servo mechanism and receiver unit 19. With this arrangement, the servo mechanism and receiver unit 19 via the steering control cable 55 can freely rotate the axle bar 47 within the sleeve 48.

The front wheel assembly 25 further includes the front wheel 16 that is rotatably mounted to the front axle 17. The wheel 16 is secured to the axle 17 by an axle set nut 52. The set nut 52 is adapted to be received on the lower portion of the axle bar 47 so that the front axle 17 and wheel 16 may be removably secured to the axle bar 47 for storage or transportation purposes.

Figure 7:
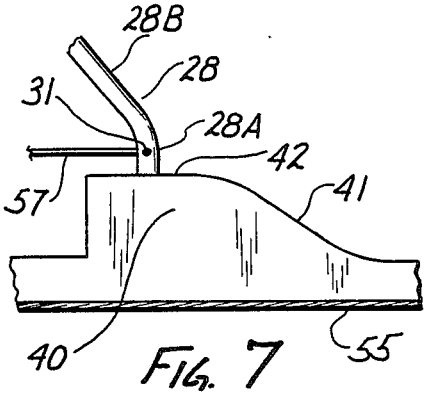
FIG. 7 is an enlarged fragmentary elevational view of the central portion of the frame or body of the land sail toy vehicle of FIG. 1.
Figure 8:
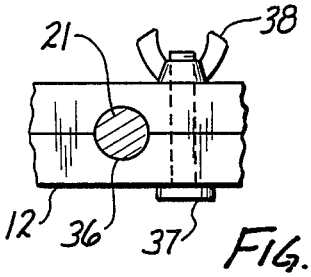
FIG. 8 is an enlarged fragmentary elevational view of the body and rear axle of the toy vehicle of FIG. 1.

Considering now the mast assembly 25 in greater detail with reference to FIGS. 1, 2 and 7, the mast assembly includes a mounting socket 26 that is adapted to receive the mast boom 27 and 29 and a mounting bar 28. The mounting bar 28 is a short stubbed metallic tube pivotally received within a pivot socket (not shown) disposed within a hole 43 in the top surface 42 of the protuberance 40. The mounting bar 28 includes a hole 31 for receiving a mast control cable 56 attached to the servo mechanism and receiver unit 19. The mounting bar 28 includes a straight portion 28A and a rake or backwardly angularly inclined portion 28B at a suitable angle to the vertical so as to correspond with the predetermined rake of the mast boom 27. The terminal end of the raked portion 28B of the mounting bar 28 is adapted to be received within the mounting socket 26.

Figure 5:
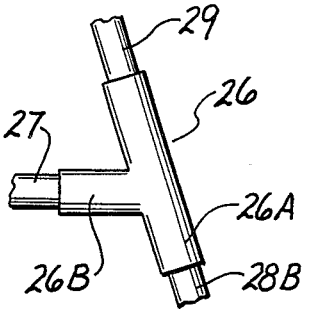
FIG. 5 is an enlarged fragmentary elevational view of the boom socket of the land sail toy vehicle of FIG. 1.
Figure 4:
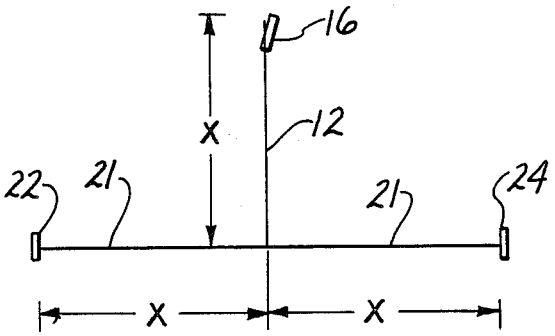
FIG. 4 is a schematic plan view showing the land sail toy vehicle of FIG. 1, illustrating its body and rear axle dimensions.

Considering now the mounting socket 26 in greater detail with reference to FIG. 5, the mounting socket 26 is generally Y-shaped member comprised of a suitable rigid material. The arm section 26A and 26B are tubular and are adapted to receive the respective ends of the mast booms 27 and 29. Arm section 26B is also adapted to receive at its opposite end from boom 29 the rake portion 28B of the mounting bar 28.

The mast assembly 25 further includes the sail 30 which has a set of transversely extending, spaced-apart stiffening batters 32, 33 and 34. The batters 32, 33, and 34 are held in place by a Velcro strip, such as strip 35, or by a sleeve (not shown) sewn to the sail. Accordingly, batters may be easily added or removed from the sail 30 depending on the prevailing wind conditions. The lower terminal end of the sail 30 is adapted to be received on the mast boom 27, while the forward terminal edge of the sail 30 is adapted to be received on the mast boom 29. This type of mounting is particularly useful as it enables the entire mast assembly to be easily and quickly disabled and assembled and it assumes the rake of the boom is inclined in a desirable manner to position the center of gravity of the sail 30 substantially directly over the terminal end of the frame 12 and the rear axle 21 when the mast boom 27 is disposed in a perpendicularly parallel plane to the frame 12.

Considering now the servo mechanism and receiver unit 19 in greater detail with reference to FIGS. 1 and 2, a pair of control cables 55 and 57 are connected to the servo drives and enable the front wheel steering and must be controlled. The internal electronics of the servo mechanism are conventional and include the standard radio receiver for receiving remote radio signals from the radio transmitter 20. An antenna wire 58 is connected to the receiver at one end and is connected to the metal rear axle member 21 at its opposite end so that the axle member 21 helps serve as the antenna for the servo mechanism and receiver unit 19. An on/off switch 59 enables the servo mechanism power to be turned on or off as needed.

A restraining bar 60 is mounted on top of the receiver to limit the swinging motion of the sail 30 and its horizontal boom 27. The restraining bar is U shaped and includes a bight portion 61, and a pair of upstanding legs 62 and 63 disposed on opposite sides of the horizontal boom 27 to engage the sail 30 when it swings thereagainst under the force of the wind. Leg 61 is mounted to the top wall of the housing for the receiver. Leg 61 is generally a hollow tube adapted to secure removably the legs 62 and 63. The legs 62 and 63 extend perpendicularly upwardly from the legs 61 and terminate at a point which is slightly above the horizontal mounting plane of the mast boom 27. Legs 62 and 63 are therefore mounted to act as stops for the mast assembly 25 as it pivots about the pivot socket 43.

It should be understood that the distance between the two legs 62 and 63 may be varied by a user to allow greater or lesser swinging of the mast assembly 25. Optimally however, the spacing between the legs 62 and 63 is adjusted to enable the center of gravity of the sail 30 to remain substantially over the rear axle 21 at all times during the swinging motion of the mast assembly.

Also, in order to help limit the swinging movement of the mast assembly to position the center of gravity of the sail 30 above the rear axle 21, a tether line 71 is connected between the rear end of the horizontal boom 27 and the rear end of the frame 12.

While a particular embodiment of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A remotely controlled wind propelled land vehicle comprising:

a rod-like frame;

elongated rear axle section means, having two free ends;

a single pair of wheels rotatably mounted to the free ends of said rear axle section;

axle mounting means for connection said rear axle section to one end of said frame and to maintain said single pair of wheels in substantial contact with the ground as the vehicle rollably moves along the ground;

said rear axle section means extending laterally from said frame with said free ends being disposed on opposite sides of said frame;

means disposed at the opposite end of said frame member for mounting a forward axle assembly to said frame member, said forward axle assembly having a single wheel rotatably mounted thereto to enable said single wheel and said single pair of wheels to support said vehicle solely for rollable movement along the ground;

steering means mounted to said frame for turning said forward wheel, said steering means being responsive to remote control signals;

mast means for supporting an upright sail assembly, said mast means being swingably mounted to said frame for controlled lateral swinging movement thereof, said mast means disposed centrally of said frame member and projecting upward and inclined rearwardly therefrom to align said sail assembly substantially perpendicularly to said rear axle section when said sail assembly is disposed parallel to said frame member;

said frame member being dimensioned along its longitudinal axis to be substantially the same length as said rear axle section;

means for positioning said mast means with the center of gravity thereof being disposed substantially above said rear axle section means when the mast means is aligned with the frame member; and restraining means for limiting the free lateral swinging movement of said mast means to maintain the center of gravity of said sail assembly disposed substantially directly above the rear axle section while the vehicle is propelled along the ground as the mast means swings side to side.

2. A remotely controlled wind-propelled land vehicle as defined in claim 1, further comprising:

a remote control receiver responsive to remote control signals; and coupling means for actuating said steering means in response to remote control signals.

3. A remote controlled wind-propelled land vehicle as defined in claim 1, further comprising:

a remote control receiver responsive to remote control signals; and coupling means for pivoting said mast means in response to remote control signals.

4. A remotely controlled wind-propelled land vehicle as defined in claim 1 wherein said steering means includes a single pivot mounting for supporting a single axle having a single wheel.

5. A remotely controlled wind-propelled land vehicle as defined in claim 1 wherein said mast means includes mounting means for removably and pivotally mounting said mast means to said frame;

said mounting means including a Y-shaped mounting socket adapted to receive a mounting bar for removably attaching said mounting socket to said frame, a first mast boom, said first mast boom being disposed substantially in a plane parallel to the longitudinal axis of said frame, and a second mast boom, said second mast boom projecting upwardly and inclined rearwardly from said frame.

6. A remotely controlled wind propelled land vehicle as defined in claim 5, wherein said first and second mast booms are adapted to receive the upright sail assembly.

7. A remotely controlled wind propelled land vehicle as defined in claim 6, wherein said sail is adapted to removably receive a plurality of battens.

* * * * *